United States Patent [19]

Buoli

[11] Patent Number: 4,697,161

[45] Date of Patent: Sep. 29, 1987

[54] DIRECTIONAL COUPLERS OF THE BRANCHLINE TYPE

[75] Inventor: Carlo Buoli, Mirandola, Italy

[73] Assignee: 501 GTE Telecomunicazioni S.p.A., Milan, Italy

[21] Appl. No.: 773,688

[22] Filed: Sep. 5, 1985

[30] Foreign Application Priority Data

Oct. 30, 1984 [IT] Italy ..... 23387 A/84

[51] Int. Cl.[4] ..... H01P 5/18

[52] U.S. Cl. ..... 333/116; 333/238

[58] Field of Search ..... 333/116

[56] References Cited

U.S. PATENT DOCUMENTS 3,996,533 12/1976 Lee ..... 333/116

4,075,581 2/1978 Davidson et al. ..... 333/116

*Primary Examiner*—Paul Gensler

*Attorney, Agent, or Firm*—Jeffrey P. Morris

[57] ABSTRACT

A directional coupler of the 3 DB and 90 degree branchline type with four ports. Four pairs of coupled lines of microstrip construction provide the connections between the ports. The first and third ports are opposite each other as are the second and fourth ports, with the first and third ports connected to associated circuits and the second and fourth ports unconnected.

2 Claims, 5 Drawing Figures

DIRECTIONAL COUPLERS OF THE BRANCHLINE TYPE

The present invention relates to power dividers in use in microwave systems and particularly to a 3 dB and 90° directional coupler of the branchline type.

It is well known that in a number of microwave circuits, such as for example mixers, power amplifiers and some more the problem arises to divide or add powers, which problem is generally solved by the use of directional couplers.

The power division can be made according to any ratio. The most used ratio is 1:1 which involves a 3 dB directional coupler.

At present various types of 3 dB couplers with a 90° phase shift between the coupled parts are used. One of them is the conventional branchline coupler, a second one is the combination of two 8.3 dB couplers to obtain a 3 dB coupler and a third one is the interdigital coupler known in the art as "Lange coupler".

These types of couplers have, however, various disadvantages, among which the following are the most important.

In the conventional branchline type for frequencies higher than 10 GHz the ratio of the wave length to the cross-section of the branches is lower than 10 and as a result the propagation conditions are altered inasmuch as modes higher than TEM occur and, in addition, the discontinuities of the four apices are no longer negligible so that matching and directivity problems arise.

The same disadvantages occur in the coupler obtained by means of a combination of two 8.3 dB couplers.

A third above mentioned type of coupler, i.e. the "Lange coupler" has the disadvantage that it requires at least 2 (typically 4) bonds.

In addition, all the above mentioned type of couplers require the use of direct current blocking capacitors when active circuits are used inasmuch as the four ports are connected.

It is the object of the present invention to obviate these and other disadvantages of the prior art directional couplers.

More particularly the directional coupler of the 3 dB and 90° branchline type according to the present invention is characterized in that each of the four branches of the coupler consists of two coupled lines of which only two out of their four ports, geometrically opposite, are connected in the circuit whereas the two remaining ports remain open.

The directional coupler according to the present invention reduces the cross-section of the branches of the 3 dB and 90° branchline couplers, thus securing a good operation up to 20 GHz and provides the direct current isolation of the four ports so as to eliminate the need for D.C. blocking capacitors when active circuits are used.

These and other features of the present invention will become more apparent from the following description of a preferred embodiment thereof given by way of example and in no limiting sense, referring to the accompanying drawings, in which.

Figure 1:
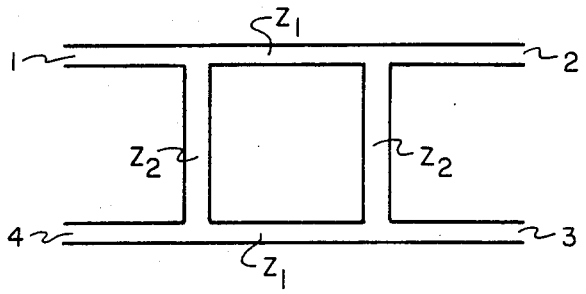
FIG. 1 (PRIOR ART)
FIG. 1 is a principle block diagram of a conventional branchline coupler.

The principle diagram of the branchline coupler shown in FIG. 1 is well known to those skilled in the art and is shown here to evidence the circuit modification made by the present invention. In said diagram if the reference impedance Ro is by way of example 50 ohm and the coupler is a 3 dB coupler, then Z1=Ro and $Z2=Ro/\sqrt{2}$.

Figure 2:
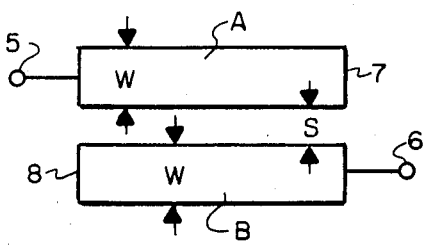
FIG. 2 is a diagram of coupled lines as used by the invention.

Referring to FIG. 2, A and B indicate the two coupled lines forming the base structure of each branch of the coupler.

5 and 6 indicate the ports used and 7 and 8 the two open ports. W indicates the width of the line and S the distance between the lines.

It is well known that two coupled lines are characterized by the following magnitudes:

ZE=characteristic impedance of the even mode

Zo=characteristic impedance of the odd mode $\theta E$=electric angle of the even mode $\theta o$=electric angle of the odd mode By sizing W and S (FIG. 2) so that $$\frac{ZE - Zo}{2} = Z1 \text{ and } \frac{\theta E - \theta o}{2} = 90°$$

the lines having a characteristic impedance equal to Z1 (FIG. 1) can be substituted by two coupled lines structures as diagrammatically shown in FIG. 2.

The same applies to the characteristic impedance Z2 of FIG. 1.

Figure 3:
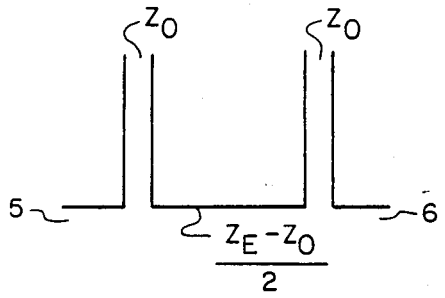
FIG. 3 is a diagram of a circuit equivalent to the coupled lines of FIG. 2.

The equivalent circuit for the coupled lines of FIG. 2, well known to those skilled in the art, is shown in FIG. 3 and needs no further description.

Figure 4:
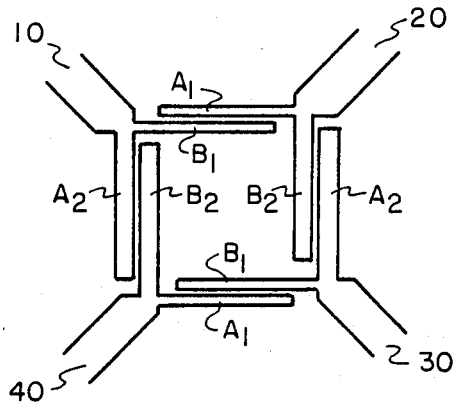
FIG. 4 is a diagram of the coupler according to the invantion.

The coupler according to the invention using the coupled lines of FIG. 2 can take, by way of example, the geometry illustrated in FIG. 4.

In it, 10, 20, 30, 40 indicate the ports corresponding to the ports 1, 2, 3, 4 of FIG. 1.

A1 B1, A2 B2 are coupled lines which in the present invention are made of microstrips of any type.

Microstrips are well known in electronic component technology.

The coupling between the lines A1 and B1, A2 and B2 is provided by way of example, by means of the inner/outer exchange evidenced in FIG. 2.

Other geometries could be, however, provided.

Figure 5:
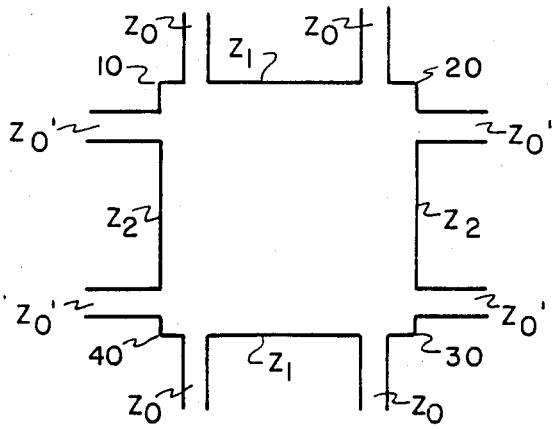
FIG. 5 is a diagram of a circuit equivalent to the coupler of FIG. 4.

The operation of the circuit of FIG. 4 is illustrated diagrammatically by means of the equivalent circuit of FIG. 5, which operation becomes apparent as an application of the equivalent circuit of an individual branch shown in FIG. 3.

In FIG. 5, Z1 indicates the quantity (ZE−Zo)/2 and Z2 indicates the quantity (ZE′−Zo′/2 where Z1 and Z2 are the impedances forming the branches of the branchline ZE and Zo are respectively the characteristic impedance of the even mode and the characteristic impedance of the odd mode of the branches 10–20, 30–40 of FIGS. 4 and 5 from which we obtain the first characteristic impedance Z1 equals (ZE−Zo)/2. ZE′ and Zo′ are respectively the characteristic impedance of the even mode and the characteristic impedance of the odd mode of the branches 10–40, 20–30 of FIGS. 4 and 5 from which we obtain the second characteristic impedance Z2 equals (ZE'−Zo')/2.

These impedance values will be obviously obtained by suitably sizing the microstrips A1, B1, A2, B2 forming the four branches, in particular the width W (FIG. 2) of the lines and the distance S between the lines.

While but one embodiment of the invention has been described and illustrated, it is obvious that a number of changes and modification can be made without departing from the scope of the invention.

I claim:

1. A directional coupler of the 3 dB and 90° branch-line type, comprising:

first, second, third and fourth ports;

first, second, third and fourth pairs of coupled lines of microstrip construction;

a first branch, including connections to one of said first pair of coupled lines and one of said fourth pair of coupled lines, forming said first port;

a second branch, including circuit connections to the other of said first pair of coupled lines and one of said second pair of coupled lines forming said second port;

a third branch, including circuit connections to the other of said second pair of coupled lines and one of said third pair of coupled lines, forming said third port;

a fourth branch, including circuit connections to the other of said third pair of coupled lines and the other of said fourth pair of coupled lines, forming said fourth port;

said first and third ports positioned geometrically opposite each other and including circuit connections to an associated circuit;

and said second and fourth ports unconnected to an associated circuit.

2. A directional coupler, as claimed in claim 1, wherein:

said coupled lines of microstrip construction are dimensioned so that the difference between the impedance of the even mode and the impedance of the odd mode is equal to the impedances forming the branches of said coupler.

* * * * *